US007463155B2

(12) United States Patent
Narlow et al.

(10) Patent No.: US 7,463,155 B2
(45) Date of Patent: Dec. 9, 2008

(54) TECHNIQUES FOR RADIO FREQUENCY IDENTIFICATION AND ELECTRONIC ARTICLE SURVEILLANCE RECEIVERS

(75) Inventors: Douglas A. Narlow, Coral Springs, FL (US); Gary M. Shafer, Boca Raton, FL (US); Hubert A. Patterson, Boca Raton, FL (US); Kevin Romer, Boca Raton, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 209 days.

(21) Appl. No.: 11/144,876

(22) Filed: Jun. 3, 2005

(65) Prior Publication Data

US 2006/0273910 A1 Dec. 7, 2006

(51) Int. Cl.
*G08B 13/14* (2006.01)

(52) U.S. Cl. ..... 340/572.7; 340/572.1; 340/10.1; 340/10.4; 455/101; 455/561

(58) Field of Classification Search ... 340/572.1–572.9, 340/10.32, 10.33, 10.4, 10.51, 10.52, 825.7, 340/825.72, 825.73; 455/101, 561
See application file for complete search history.

(56) References Cited

U.S. PATENT DOCUMENTS 4,818,973 A * 4/1989 Yamakawa et al. ..... 340/572.1
6,127,928 A * 10/2000 Issacman et al. ..... 340/572.1
6,362,738 B1 3/2002 Vega
6,617,962 B1 * 9/2003 Horwitz et al. ..... 340/10.4
7,075,412 B1 * 7/2006 Reynolds et al. ..... 340/10.2
7,132,946 B2 * 11/2006 Waldner et al. ..... 340/572.1
7,265,675 B1 * 9/2007 Carrender et al. ..... 340/572.7
2004/0160323 A1 8/2004 Stilp
2004/0164864 A1 8/2004 Chung
2005/0052282 A1 * 3/2005 Rodgers et al. ..... 340/572.1
2006/0132312 A1 * 6/2006 Tavormina ..... 340/572.7

OTHER PUBLICATIONS

PCT International Search Report dated Jun. 3, 2005 (Appln. No. PCT/US2006/021726) International Searching Authority: European Patent Office.

* cited by examiner

*Primary Examiner*—George A Bugg
*Assistant Examiner*—Edny Labbees
(74) *Attorney, Agent, or Firm*—Kacvinsky LLC

(57) ABSTRACT

A system, apparatus, and method to combine radio frequency identification and electronic article surveillance receivers into a single device are described wherein a first selection signal is sent to switch a first switch to a first state to connect a receiver to a first antenna in order to detect a first type of security tag in a first operating mode and a second selection signal is sent to switch the first switch to a second state to connect the receiver to a second antenna to detect a second type of security tag in a second operating mode. Other embodiments are described and claimed.

20 Claims, 4 Drawing Sheets

TECHNIQUES FOR RADIO FREQUENCY IDENTIFICATION AND ELECTRONIC ARTICLE SURVEILLANCE RECEIVERS

BACKGROUND

An Electronic Article Surveillance (EAS) system is designed to prevent unauthorized removal of an item from a controlled area. A typical EAS system may comprise a monitoring system and one or more security tags. The monitoring system may create a surveillance or interrogation zone at an access point for the controlled area. A security tag may be fastened to an item, such as an article of clothing. If the tagged item enters the interrogation zone, an alarm may be triggered indicating unauthorized removal of the tagged item from the controlled area.

Some EAS systems may be arranged to detect multiple types of security tags. This may be accomplished using one or more transmitters communicating different types of signals into the interrogation zone. Such systems typically need multiple receivers to receive the corresponding different signals. The use of multiple receivers, however, may increase the complexity and cost of the EAS system. Consequently, there may be need for improvements in conventional EAS systems to solve these and other problems.

SUMMARY OF THE INVENTION

Embodiments of the invention may include systems and techniques for radio frequency identification (RFID) and EAS receivers, such as an apparatus comprising an antenna system having multiple antennas; a first switch to connect to the antenna system; a receiver to connect to the switch; and a processor to connect to the first switch, the processor to switch the first switch to a first state to connect the receiver to a first antenna in order to detect a first type of security tag in a first operating mode, and the processor to switch the first switch to a second state to connect the receiver to a second antenna to detect a second type of security tag in a second operating mode.

The invention may also be embodied in a method comprising the steps of sending a first selection signal to switch a first switch to a first state to connect a receiver to a first antenna in order to detect a first type of security tag in a first operating mode; and sending a second selection signal to switch the first switch to a second state to connect the receiver to a second antenna to detect a second type of security tag in a second operating mode.

BRIEF DESCRIPTION OF THE DRAWINGS

For a better understanding of various embodiments of the invention, reference should be made to the following detailed description which should be read in conjunction with the following figures wherein like numerals represent like parts.

DETAILED DESCRIPTION

Figure 1:
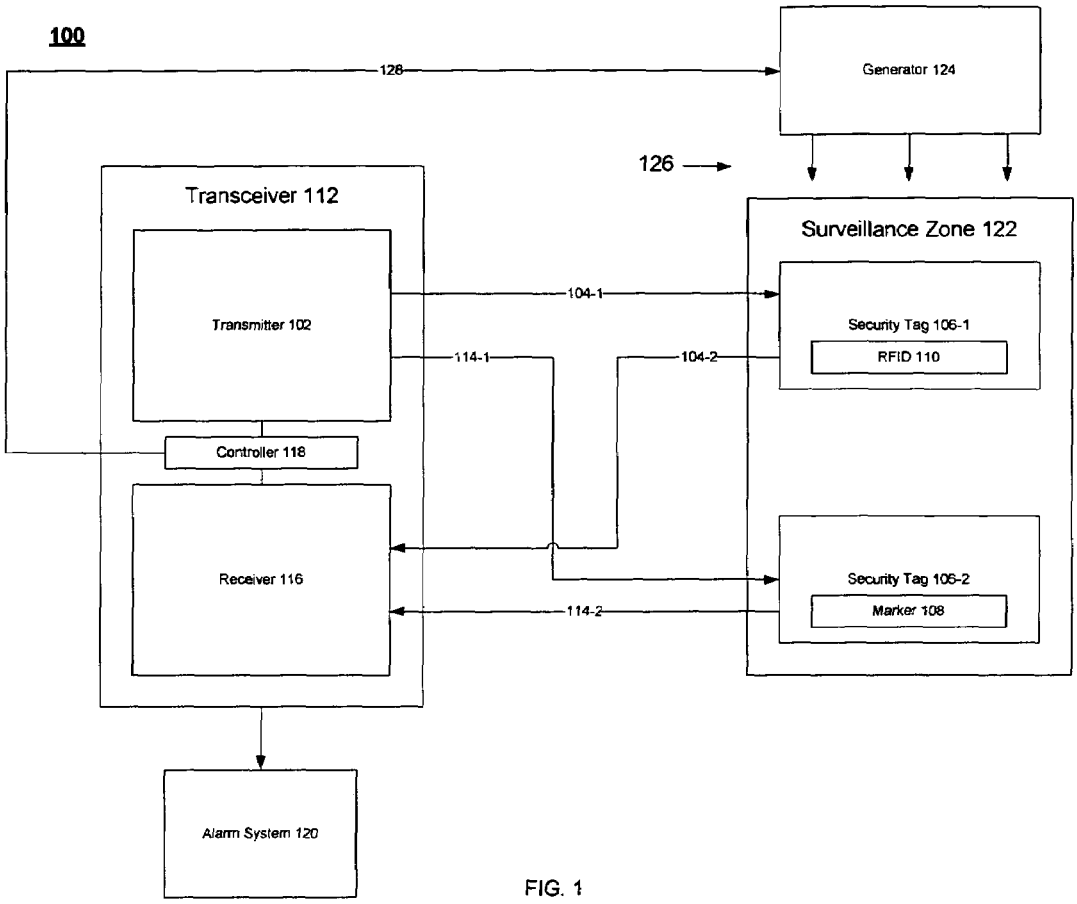
FIG. 1 illustrates a block diagram of a system in accordance with one embodiment.

For simplicity and ease of explanation, the invention will be described herein in connection with various embodiments thereof. Those skilled in the art will recognize, however, that the features and advantages of the invention may be implemented in a variety of configurations. It is to be understood, therefore, that the embodiments described herein are presented by way of illustration, not of limitation.

Some embodiments of the invention may be directed to an EAS system that is arranged to detect different types of security tags. By having an EAS system capable of detecting different types of tags, it becomes possible to use different security tags for different items. For example, more expensive radio frequency identification (RFID) security tags may be used on certain inventory of interest, while less expensive RF or EAS security tags may be used on the balance of the inventory. Consequently, the inventory of interest may be tracked using the RFID tags, while still being able to detect theft across the entire inventory. Accordingly, the overall cost of the EAS system and corresponding security tags may be reduced, thereby benefiting the manufacturer, retailer and customer. This may be particularly beneficial-to those businesses carrying large volumes of inventory that require varying levels of inventory tracking capabilities but total anti-theft solutions, such as found in the video and Digital Versatile Disc (DVD) rental market, for example.

Some embodiments may be arranged to detect multiple types of security tags using a single transmitter/receiver ("transceiver"). Former solutions typically use a separate transceiver for each type of security tag, with each transceiver having its own set of associated hardware, software, antennas, cabling, housing, and so forth. This may add to the cost and clutter of the access point for the controlled area, which is typically a retail store front. Some embodiments may reduce these and other problems by combining the separate transceivers into a single unit. This may be accomplished, for example, by creating a common RF and IF signal path in the transceiver, and controlling the use of the single transceiver for a given type of security tag by placing it in various operating modes. For example, the transceiver may be switched to an RFID mode, an EAS mode, or a combination EAS/RFID mode. The detection of EAS and RFID signals may occur at the base-band level by a central processor or controller. As a result, the use of a single transceiver may significantly reduce power, space and cost requirements for the overall EAS system.

Numerous specific details may be set forth herein to provide a thorough understanding of the embodiments. It will be understood by those skilled in the art, however, that the embodiments may be practiced without these specific details. In other instances, well-known methods, procedures, components and circuits have not been described in detail so as not to obscure the embodiments. It can be appreciated that the specific structural and functional details disclosed herein may be representative and do not necessarily limit the scope of the embodiments.

It is worthy to note that any reference in the specification to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Referring now in detail to the drawings wherein like parts are designated by like reference numerals throughout, there is illustrated in FIG. 1 a system suitable for practicing one embodiment. FIG. 1 illustrates an EAS system 100. EAS system 100 may comprise monitoring equipment configured to monitor a surveillance zone, such as surveillance zone 122. More particularly, the monitoring equipment may be configured to detect the presence of multiple security tags within surveillance zone 122. The area selected for surveillance zone 122 may be sized to the access point for a controlled area as desired for a given implementation. The embodiments are not limited in this context.

In one embodiment, for example, EAS system 100 may include a transmitter 102, security tags 106-1-n, a receiver 116, a controller 118, an alarm system 120, and a generator 124. Although FIG. 1 shows a limited number of elements, it can be appreciated that any number of additional elements may be used in system 100. The embodiments are not limited in this context.

In one embodiment, EAS system 100 may be arranged to detect multiple security tags 106-1-n . Security tags 106-1-n may be designed to attach to an item to be monitored. The item may comprise any commercial good, such as a garment, article of clothing, packaging material, DVD and compact disk (CD) jewel cases, glasses, boxes, a movie rental container, packaged item, and so forth. The embodiments are not limited in this context.

In one embodiment, security tags 106-1-n may be of different types. For example, security tag 106-1 may comprise a first type of security tag, such as an RFID security tag implemented using an RFID chip 110. RFID chip 110 may be capable of storing data and may communicate the stored data in response to an RF interrogation signal, such as interrogation signal 104-1. Security tag 106-1 may receive interrogation signal 104-2 via an RF antenna and emit a detectable signal 104-2 when in surveillance zone 122. Signal 104-2 may not only be used to detect the presence of security tag 106-2 while in surveillance zone 122 as with security tag 106-2, but may further include a data stream of information stored by RFID chip 110. The amount of stored data may vary according to the amount of memory resources available to RFID chip 110. In one embodiment, RFID chip 110 may comprise a passive RFID chip that is powered by the interrogation signal and therefore does not require a separate power source. The embodiments are not limited in this context.

In one embodiment, for example, security tag 106-2 may comprise a second type of security tag, such as an EAS security tag implemented using a marker 108. Marker 108 may comprise one or more RF antennas and a RF sensor to receive an interrogation signal 114-1 and emit a detectable signal 114-2 when in surveillance zone 122. Security tag 106-2 may have a lower level of complexity relative to other types of security tags (e.g., security tag 106-1) since signal 114-2 is limited to indicating the presence of security tag 106-2 within surveillance zone 122. Examples for marker 108 may include any EAS sensor modified to operate in accordance with the principles discussed herein. Further, the sensor may be a sensor that is capable of being deactivated or not deactivated, depending upon a given implementation. The embodiments are not limited with respect to the type of sensor used for marker 108 as long as it emits a detectable signal at the proper frequencies.

Security tags 106-1 and 106-2 may have similar or different security tag housings, depending upon a particular implementation. For example, in one embodiment the security tag housings may be hard or soft, depending on whether the security tags are designed to be reusable or single-use tags. For example, a reusable security tag typically has a hard security tag housing to endure the rigors of repeated attaching and detaching operations. A single-use security tag may have a hard or soft housing, depending on such as factors as cost, size, type of tagged item, visual aesthetics, tagging location, and so forth. The embodiments are not limited in this context.

In one embodiment, EAS system 100 may comprise transceiver 112. Transceiver 112 may comprise, for example, a microwave transceiver. Transceiver 112 may comprise a transmitter 102 and a receiver 116, each connected to a controller 118. Although FIG. 1 shows transceiver 112 with a limited number of elements, it can be appreciated that any number of additional elements may be used in transceiver 112. The embodiments are not limited in this context.

In one embodiment, transmitter 102 may be implemented using any transmitter system arranged to transmit an electromagnetic signal at a certain operating frequency. In general, transmitter 102 may comprise a one or more transmitter antennas operatively coupled to an output stage, which in turn is connected to a controller, such as controller 118 of receiver 116. The output stage may comprise various conventional driving and amplifying circuits, including a circuit to generate a high frequency electric current. When the high frequency electric current is supplied to the transmitter antennas, the transmitter antennas may generate high frequency electromagnetic signals 104-1 and 114-1 around the transmitter antenna. Electromagnetic signals 104-1 and 114-1 may propagate into surveillance zone 122.

In one embodiment, transmitter 102 may be arranged to transmit different signals at different operating frequencies. For example, transmitter 102 may be arranged to transmit electromagnetic signals 104-1 and 114-1 at certain operating frequencies used by security tags 106-1 and 106-2, respectively. The particular operating frequency assigned to a given security tag may vary over a range of available frequencies as regulated by a governmental entity. Some embodiments may be arranged to operate using an operating frequency that is part of the ultra-high frequency (UHF) spectrum. Depending upon the application, the operating frequency may be set within several hundred Megahertz (MHz) or higher, such as 868-950 MHz, for example. In one embodiment, for example, transmitter 102 may be arranged to operate within an EAS operating frequency, such as the 868 MHz band used in Europe, the 915 MHz Industrial, Scientific and Medical (ISM) band used in the United States, the 950 MHz band proposed for Japan, and so forth. It may be appreciated that these operating frequencies are given by way of example only, and the embodiments are not limited in this context.

In one embodiment, EAS system 100 may comprise a receiver 116. Receiver 116 may comprise any receiver system arranged to receive electromagnetic signals at the selected operating frequency, such as signals 104-2 and 114-2 from security tags 106-1 and 106-2, respectively. For example, receiver 116 may comprise conventional amplifying and signal-processing circuits, such as band pass filters, mixers and amplifier circuits. In addition, receiver 116 may comprise an output stage connected to controller 118, which is configured to receive and process modulated reply signals 104-2 and 114-2. The processed signals may then be forwarded to controller 118 to perform detection operations.

In one embodiment, EAS system 100 may comprise generator 124. Generator 124 may be configured to generate an electric field ("e-field") or magnetic field. In one embodiment, for example, generator 124 may comprise an e-field generator operating in the 1 Kilohertz (KHz) to 1 Megahertz (MHz) range to form modulations signals 126. In another embodiment, for example, generator 124 may comprise a coil arrangement to generate a low frequency alternating current (AC) magnetic field operating in the 1-10 KHz range to form modulation signals 126. Generator 124 may be configured to generate the electric field or magnetic field with sufficient strength to cover the same area as surveillance zone 122.

In one embodiment, EAS system 100 may comprise controller 118. Controller 118 may comprise a processing and control system configured to manage various operations for EAS system 100. For example, controller 118 may receive processed signals from receiver 116. Controller 118 may use the processed signals to determine whether one or more security tags 106-1-n are within surveillance zone 122. For example, modulated reply signals 104-2 and/or 114-2 may include a number of detectable sidebands around the center frequency. At least one sideband may be used to determine if security tags 106-1 and/or 106-2 are within surveillance zone 122. If security tags 106-1 and/or 106-2 are detected within surveillance zone 122, controller 118 may generate a detect signal and forward the signal to alarm system 120.

In one embodiment, EAS system 100 may comprise alarm system 120. Alarm system 120 may comprise any type of alarm system to provide an alarm in response to an alarm signal. The alarm signal may be received from any number of EAS components, such as controller 118. Alarm system 120 may comprise a user interface to program conditions or rules for triggering an alarm. Examples of the alarm may comprise an audible alarm such as a siren or bell, a visual alarm such as flashing lights, or a silent alarm. A silent alarm may comprise, for example, an inaudible alarm such as a message to a monitoring system for a security company. The message may be sent via a computer network, a telephone network, a paging network, and so forth. The embodiments are not limited in this context.

Figure 2:
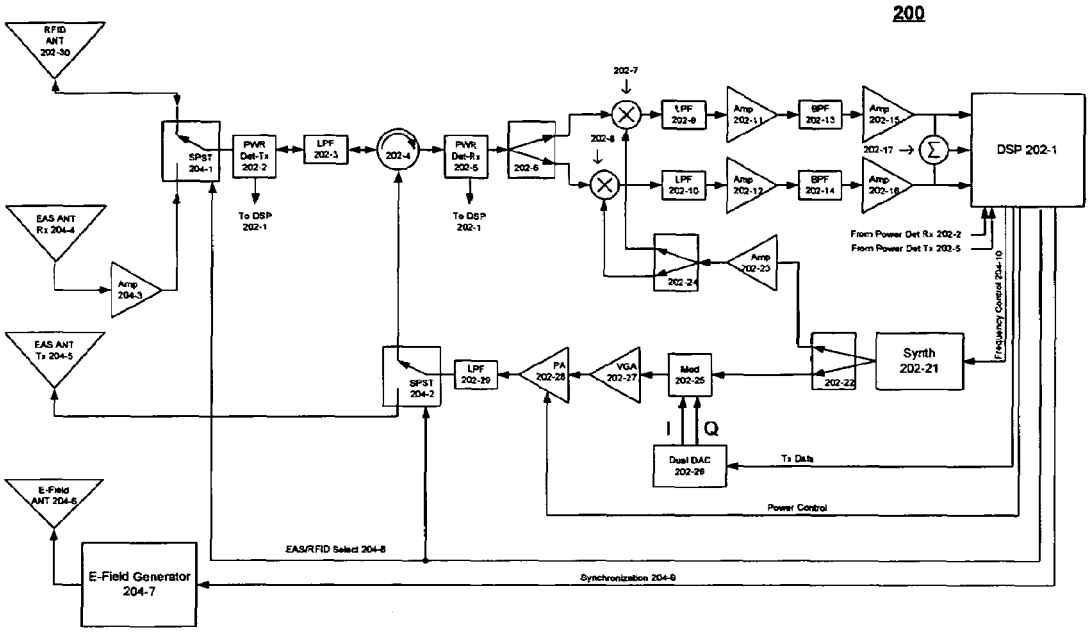
FIG. 2 illustrates a block diagram of a first transceiver in accordance with one embodiment.

FIG. 2 illustrates a block diagram of a first transceiver in accordance with one embodiment. FIG. 2 illustrates a block diagram of a transceiver 200 suitable for use with system 100 as described with reference to FIG. 1, such as transceiver 112, for example. The embodiments are not limited, however, to the example given in FIG. 2.

As shown in FIG. 2, transceiver 200 may comprise multiple elements, such as elements 202-1-p and 204-1-q, where p and q represent any positive integer. Elements 202-1-p and 204-1-q may comprise, or be implemented as, one or more circuits, components, registers, processors, software subroutines, modules, or any combination thereof, as desired for a given set of design or performance constraints. Although FIG. 2 shows a limited number of elements by way of example, it can be appreciated that more or less elements may be used in transceiver 200 as desired for a given implementation. The embodiments are not limited in this context.

In one embodiment, transceiver 200 may include an element 202-1. In one embodiment, for example, element 202-1 may comprise a processor. For example, processor 202-1 may be implemented as a general purpose processor or a dedicated processor, such as a controller, microcontroller, embedded processor, a digital signal processor (DSP), a field programmable gate array (FPGA), a programmable logic device (PLD), and so forth. In one embodiment, for example, element 202-1 may be implemented as a DSP. The embodiments are not limited in this context.

In one embodiment, DSP 202-1 may have access to one or more memory units (not shown). The memory units may include any machine-readable or computer-readable media capable of storing data, including both volatile and non-volatile memory. For example, the memory may include read-only memory (ROM), random-access memory (RAM), dynamic RAM (DRAM), Double-Data-Rate DRAM (DDRAM), synchronous DRAM (SDRAM), static RAM (SRAM), programmable ROM (PROM), erasable programmable ROM (EPROM), electrically erasable programmable ROM (EEPROM), flash memory, polymer memory such as ferroelectric polymer memory, ovonic memory, phase change or ferroelectric memory, silicon-oxide-nitride-oxide-silicon (SONOS) memory, magnetic or optical cards, or any other type of media suitable for storing information. The embodiments are not limited in this context.

In one embodiment, DSP 202-1 may be representative of one or more elements shown in FIG. 1, such as controller 118, for example. DSP 202-1 may comprise a processing and control system arranged to manage various operations for transceiver 200. For example, DSP 202-1 may be used to manage various operating modes for transceiver 202. The operating modes may include, for example, an RFID mode, an EAS mode, and a combined RFID/EAS mode. The RFID mode may comprise, for example, the mode where transceiver 200 is used to communicate with security tag 106-1, such as transmitting interrogation signals 104-1 to security tag 106-1, and receiving reply signals 104-2 from security tag 106-1. The EAS mode may comprise, for example, the mode where transceiver 200 is used to communicate with security tag 106-2, such as transmitting interrogation signals 114-1 to security tag 106-2, and receiving reply signals 114-2 from security tag 106-2. The RFID/EAS mode may comprise, for example, the mode where transceiver 200 communicates with security tags 106-1 and 106-2 on a continuous basis. The embodiments are not limited in this context.

In one embodiment, transceiver 200 may comprise elements 202-1-30. Elements 202-1-30 may be representative of a set of elements used to form the RF and IF signal path for a conventional UHF RFID transceiver, including various filters, amplifiers, modulators, power detectors, synthesizers, and so forth. In one embodiment, elements 202-1-30 may also be modified for use with an EAS transceiver. Consequently, transceiver 200 may be arranged to have a common RF and IF signal path sharing elements 202-1-30 to detect different types of security tags, such as security tags 106-1 and 106-2, for example. This may be accomplished using elements 204-1-q to connect the common RF and IF signal path to a particular antenna in an antenna array. The antenna array may comprise multiple antennas, such as an RFID antenna 202-30, an EAS receive antenna 204-4, and an EAS transmit antenna 204-5, for example. The embodiments are not limited in this context.

In one embodiment, for example, transceiver 200 may be switched between multiple operating modes using elements 204-1-q. In one embodiment, for example, a first single pole single throw (SPST) switch 204-1 may be coupled to a RFID antenna 202-30. Switch 204-1 may also be coupled to an amplifier 204-3, which in turn is coupled to an EAS receive antenna 204-4. A second SPST switch 204-2 may be coupled to a circulator 202-4 and an EAS transmit antenna 204-5. Both switches 204-1 and 204-2 may be coupled to DSP 202-1. DSP 202-1 may also be coupled to an e-field generator 204-7, which in turn is coupled to an E-field antenna 204-6. E-field generator 204-7 may be representative of generator 124 as described with reference to FIG. 1. The embodiments are not limited in this context.

In operation, transceiver 200 may switch between operating modes by DSP 202-1 sending an EAS/RFID select signal 204-8 to switches 204-1 and 204-2. To switch to an RFID mode, for example, DSP 202-1 may use select signal 204-8 to place switches 204-1 and 204-2 in a first state to pass signals. To switch to an EAS mode, for example, DSP 202-1 may use select signal 204-8 to place switches 204-1 and 204-2 in a second state.

When in the first state, switch 204-1 may couple RFID antenna 202-30 to power detector 202-2 and the remaining receiving elements 202-1-p of transceiver 200. Further, switch 204-2 may couple low pass filter (LPF) 202-29 and the remaining transmitting elements 202-1-p of transceiver 200 to RFID antenna 202-30 via elements 202-2 through 202-4. While switches 204-1 and 204-2 are in the first state, transceiver 200 may operate as an RFID transceiver to send interrogations signals 104-1 to security tag 106-1, and receive RFID reply signals 104-2 from security tag 106-1, via RFID antenna 202-30.

When in the second state, switch 204-1 may couple EAS receive antenna 204-4 to receiving elements 202-1-p via amplifier 204-3. In addition, switch 204-2 may couple LPF 202-29 and the remaining transmitting elements 202-1-p of transceiver 200 to EAS transmit antenna 204-5. While switches 204-1 and 204-2 are in the second state, transceiver 200 may operate as an EAS transceiver to send interrogations signals 114-1 to security tag 106-2 via EAS transmit antenna 204-5. Further, transceiver 200 may receive EAS reply signals 114-2 from security tag 106-2 via EAS receive antenna 204-5.

In one embodiment, DSP 202-1 may also control e-field generator 204-7 using synchronization signal 204-9. For example, DSP 202-1 may turn off e-field generator 204-7 to reduce potential interference when transceiver 200 is receiving signals 104-2 and/or 114-2. The embodiments are not limited in this context.

In one embodiment, DSP 202-1 may also control the operating frequency used by transmitting elements 202-21 to 202-29 to transmit interrogation signals 104-1 and/or 114-1 using frequency control signal 202-20. The embodiments are not limited in this context.

Figure 3:
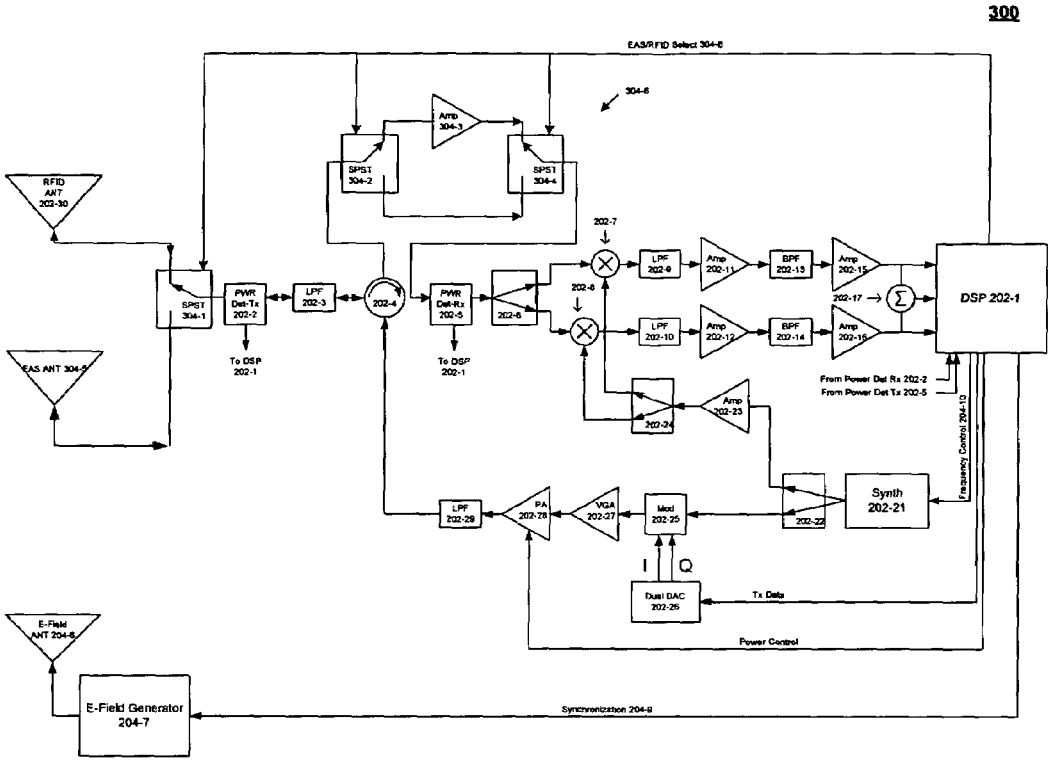
FIG. 3 illustrates a block diagram of a second transceiver in accordance with one embodiment.

FIG. 3 illustrates a block diagram of a second transceiver in accordance with one embodiment. FIG. 3 illustrates a block diagram of a transceiver 300 suitable for use with system 100 as described with reference to FIG. 1, such as transceiver 116, for example. The embodiments are not limited, however, to the example given in FIG. 3.

As shown in FIG. 3, transceiver 300 may include elements 202-1-p as described with reference to FIG. 2. In addition, transceiver 300 may comprise multiple elements 304-1-*m*. Although FIG. 3 shows a limited number of elements by way of example, it can be appreciated that more or less elements may be used in transceiver 300 as desired for a given implementation. The embodiments are not limited in this context.

In one embodiment, transceiver 300 may be similar in design and operation as transceiver 200. For example, transceiver 300 may comprise similar elements 202-1-p. Transceiver 300, however, may use a single EAS antenna 304-5 in lieu of a separate EAS receive antenna 204-4 and EAS transmit antenna 204-5 as described with reference to FIG. 2. In addition, transceiver 300 may be designed to provide additional amplification, which may be useful for some RFID applications.

In some cases, an RFID reader may have lower RF sensitivity than an EAS receiver. To compensate, additional amplification can be inserted into the signal path under control of DSP 202-1. The amplification may be switched into either the RF path or the IF path, as desired for a given implementation. The embodiments are not limited in this context.

As shown in FIG. 3, the additional amplification may be provided using amplifying module 304-6. Amplifying module 304-6 may comprise a switch 304-2 coupled to circulator 202-4. Switch 304-2 may be coupled to a switch 304-4 in a first path through an amplifier 304-3. Switch 304-2 may be coupled to switch 304-4 in a second path without any amplifying elements. Switch 304-4 may be connected to power detector 202-5 and the remaining receiving elements of transceiver 300.

In operation, transceiver 300 may switch between the various operating modes by DSP 202-1 sending an EAS/RFID select signal 304-8 to switches 304-1, 304-2 and 304-4. To switch to an RFID mode, for example, DSP 202-1 may use select signal 304-8 to place switches 304-1, 304-2 and 304-4 in a first state. To switch to an EAS mode, for example, DSP 202-1 may use select signal 304-8 to place switches 304-1, 304-2 and 304-4 in a second state.

When in the first state, switch 304-1 may couple RFID antenna 202-30 to power detector 202-2 and the remaining receiving elements 202-1-p of transceiver 300, including amplifying module 304-6. In amplifying module 304-6, switch 304-2 may also couple to switch 304-4 through the first path including amplifier 304-3. Amplifier 304-3 may provide additional amplifying gain to the signal received by RFID antenna 202-30, thereby increasing RF sensitivity relative to the EAS mode. While switches 304-1, 304-2 and 304-4 are in the first state, transceiver 300 may operate as an RFID transceiver to send interrogations signals 104-1 to security tag 106-1, and receive RFID reply signals 104-2 from security tag 106-1, via RFID antenna 202-30.

When in the second state, switch 304-1 may couple EAS antenna 304-5 to receiving elements 202-1-p. In addition, switch 304-2 may couple to switch 304-4 through the second path, thereby bypassing the additional amplification provided by amplifier 304-3. While switches 304-1, 304-2 and 304-4 are in the second state, transceiver 300 may operate as an EAS transceiver to send interrogations signals 114-1 to security tag 106-2, and receive EAS reply signals 114-2 from security tag 106-2, via EAS antenna 304-5.

To detect a given type of security tag, transceivers 200, 300 may be switched between multiple operating modes, such as an RFID mode, an EAS mode, and a combination EAS/RFID mode. Switching between the various operating modes may occur in a number of different ways. For example, a user could manually switch transceivers 200, 300 into RFID mode, EAS mode, or EAS/RFID mode. In another example, each type of security tag may be assigned a time slot to allow transceivers 200, 300 to automatically timeshare the electronics needed to transmit and/or receive a given type of signal. The duration of each time slot may vary in accordance with a given set of design constraints. For example, the duration of each time slot may be the same, thereby allowing transceivers 200, 300 to scan for different types of tags at even intervals. This may be appropriate if the inventory of a store is tagged using roughly the same number of each type of security tag. If there is a predominate number of RFID tags, however, the duration for the time slots assigned to the RFID mode may be greater than the EAS mode, and vice-versa. The embodiments are not limited in this context.

In some cases, it may be possible to add base-band processing gain to achieve additional sensitivity desired for some EAS applications. In this case, the switching elements described with reference to transceivers 200, 300 may be omitted. Both types of transceivers may instead be operated in a combined RFID/EAS mode to continuously detect both EAS security tags and RFID security tags. The embodiments are not limited in this context.

Providing additional sensitivity in transceivers 200, 300 may be accomplished in a number of different ways. For example, additional gain could be switched into the common RF and IF signal paths depending on the type of security tag detected. In another example, additional gain could be multiplexed into the common RF and IF signal paths to detect multiple security tags in a time-share scheme. In yet another example, additional processing gain could be achieved by base-band processing through signal processing, although this would come at the cost of potentially needing additional DSP processing power. The embodiments are not limited in this context.

Operations for the above embodiments may be further described with reference to the following figures and accompanying examples. Some of the figures may include programming logic. Although such figures presented herein may include a particular programming logic, it can be appreciated that the programming logic merely provides an example of how the general functionality as described herein can be implemented. Further, the given programming logic does not necessarily have to be executed in the order presented unless otherwise indicated. In addition, the given programming logic may be implemented by a hardware element, a software element executed by a processor, or any combination thereof. The embodiments are not limited in this context.

Figure 4:
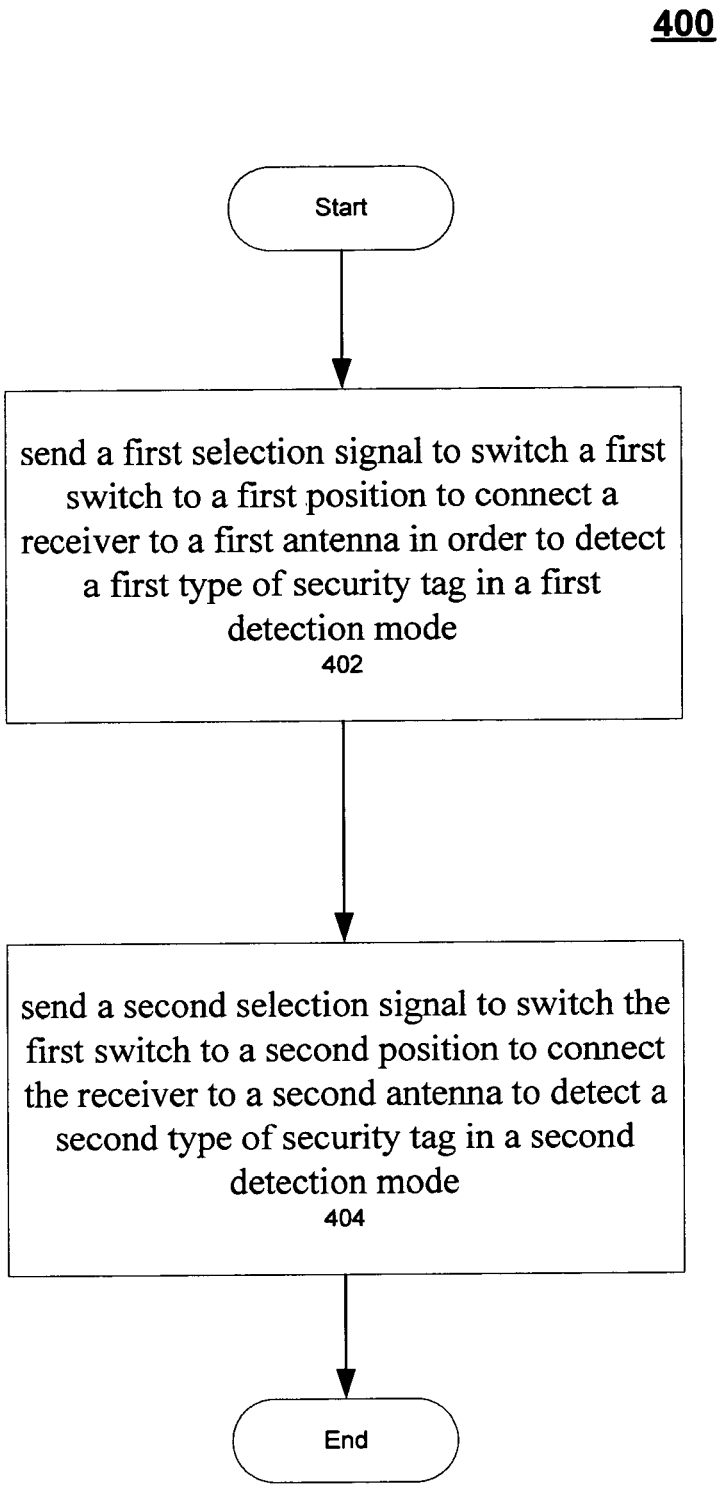
FIG. 4 illustrates a logic diagram in accordance with one embodiment.

FIG. 4 illustrates a logic diagram in accordance with one embodiment. FIG. 4 illustrates a programming logic 400. Programming logic 400 may be representative of the operations executed by one or more structure described herein, such as system 100, transceiver 200, transceiver 300, and so forth. As shown in programming logic 400, a first selection signal may be sent to switch a first switch to a first state to connect a receiver to a first antenna in order to detect a first type of security tag in a first operating mode at block 402. A second selection signal may be sent to switch the first switch to a second state to connect the receiver to a second antenna to detect a second type of security tag in a second operating mode at block 404.

In one embodiment, a received signal from the first antenna may be amplified when in the first operating mode. This may be accomplished, for example, using amplification module 304-6. The embodiments are not limited in this context.

In one embodiment, a first interrogation signal for the first type of security tag may be transmitted when the first switch is in the first state. A second interrogation signal for the second type of security tag may be transmitted when the first switch is in the second state. The embodiments are not limited in this context.

In one embodiment, the first selection signal may switch a second switch to a first state to connect a transmitter to the first antenna in order to transmit a first interrogation signal for the first type of security tag. The second selection signal may switch the second switch to a second state to connect the transmitter to a third antenna to transmit a second interrogation signal for the second type of security tag. The embodiments are not limited in this context.

Some embodiments may be implemented using an architecture that may vary in accordance with any number of factors, such as desired computational rate, power levels, heat tolerances, processing cycle budget, input data rates, output data rates, memory resources, data bus speeds and other performance constraints. For example, an embodiment may be implemented using software executed by a general-purpose or special-purpose processor. In another example, an embodiment may be implemented as dedicated hardware, such as a circuit, an application specific integrated circuit (ASIC), Programmable Logic Device (PLD) or digital signal processor (DSP), and so forth. In yet another example, an embodiment may be implemented by any combination of programmed general-purpose computer components and custom hardware components. The embodiments are not limited in this context.

Some embodiments may be described using the expression "coupled" and "connected" along with their derivatives. It should be understood that these terms are not intended as synonyms for each other. For example, some embodiments may be described using the term "connected" to indicate that two or more elements are in direct physical or electrical contact with each other. In another example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

While certain features of the embodiments have been illustrated as described herein, many modifications, substitutions, changes and equivalents will now occur to those skilled in the art. It is therefore to be understood that the appended claims are intended to cover all such modifications and changes as fall within the true spirit of the embodiments.

What is claimed is:

1. An apparatus, comprising:

an antenna system having multiple antennas;

a first switch to connect to said antenna system;

a receiver to connect to said switch;

a processor to connect to said first switch, said processor to switch said first switch to a first state to connect said receiver to a first antenna in order to detect a first type of security tag in a first operating mode, and said processor to switch said first switch to a second state to connect said receiver to a second antenna to detect a second type of security tag in a second operating mode; and an amplifying module to connect to said receiver, said amplifying module to comprise a second switch, a third switch, and an amplifier, said processor to switch said second switch and said third switch to a first state to connect said second switch to said third switch through said amplifier, and switch said second switch and said third switch to a second state to connect said second switch to said third switch without said amplifier.

2. The apparatus of claim 1, wherein said processor is a digital signal processor.

3. The apparatus of claim 1, wherein said first type of security tag is a radio frequency identification security tag.

4. The apparatus of claim 1, wherein said second type of security tag is an electronic article surveillance security tag.

5. The apparatus of claim 1, wherein said first antenna is a radio frequency identification antenna.

6. The apparatus of claim 1, wherein said second antenna is an electronic article surveillance antenna.

7. The apparatus of claim 1, further comprising a generator to connect to a third antenna, said processor to control when said generator transmits an electric field using said third antenna to reduce interference with said receiver.

8. The apparatus of claim 1, further comprising a transmitter to couple to said first switch, said transmitter to transmit a first interrogation signal for said first type of security tag when said first switch is in said first state, and said transmitter to transmit a second interrogation signal for said second type of security tag when said first switch is in said second state.

9. An apparatus, comprising:

an antenna system having multiple antennas;

a first switch to connect to said antenna system;

a receiver to connect to said switch;

a processor to connect to said first switch, said processor to switch said first switch to a first state to connect said receiver to a first antenna in order to detect a first type of security tag in a first operating mode, and said processor to switch said first switch to a second state to connect said receiver to a second antenna to detect a second type of security tag in a second operating mode, said second antenna comprising an electronic article surveillance receive antenna; and an amplifying module to connect to said receiver, said amplifying module to comprise a second switch, a third switch, and an amplifier, said processor to switch said second switch and said third switch to a first state to connect said second switch to said third switch through said amplifier, and switch said second switch and said third switch to a second state to connect said second switch to said third switch without said amplifier.

10. The apparatus of claim 9, wherein said processor is a digital signal processor.

11. The apparatus of claim 9, wherein said first type of security tag is a radio frequency identification security tag.

12. The apparatus of claim 9, wherein said second type of security tag is an electronic article surveillance security tag.

13. The apparatus of claim 9, wherein said first antenna is a radio frequency identification antenna.

14. The apparatus of claim 9, wherein said second antenna is to connect to said first switch through said amplifier.

15. The apparatus of claim 9, further comprising:

a fourth switch to connect to said antenna system;

a transmitter to connect to said fourth switch; and wherein said processor is to connect to said fourth switch, said processor to switch said fourth switch to a first state to connect said transmitter to said first antenna in order to transmit a first interrogation signal for said first type of security tag, and said processor to switch said fourth switch to a second state to connect to a third antenna to transmit a second interrogation signal for said second type of security tag.

16. The apparatus of claim 15, wherein said third antenna comprises an electronic article surveillance transmit antenna.

17. A method, comprising:

sending a first selection signal to switch a first switch to a first state to connect a receiver to a first antenna in order to detect a first type of security tag in a first operating mode;

sending a second selection signal to switch said first switch to a second state to connect said receiver to a second antenna to detect a second type of security tag in a second operating mode; and sending a third and fourth selection signals to switch second and third switches to a first state to connect said second switch to said third switch through an amplifier, and switch said second switch and said third switch to a second state to connect said second switch to said third switch without said amplifier.

18. The method of claim 17, further comprising amplifying a received signal from said first antenna when in said first operating mode.

19. The method of claim 17, further comprising:

transmitting a first interrogation signal for said first type of security tag when said first switch is in said first state; and transmitting a second interrogation signal for said second type of security tag when said first switch is in said second state.

20. The method of claim 17, wherein said first selection signal switches a fourth switch to a first state to connect a transmitter to said first antenna in order transmit a first interrogation signal for said first type of security tag, and said second selection signal switches said fourth switch to a second state to connect said transmitter to a third antenna to transmit a second interrogation signal for said second type of security tag.

* * * * *